US011180904B2

(12) United States Patent
Jones et al.

(10) Patent No.: US 11,180,904 B2
(45) Date of Patent: Nov. 23, 2021

(54) EXCAVATOR CONTROL FOR LOAD DELIVERY

(71) Applicant: Deere & Company, Moline, IL (US)

(72) Inventors: Amy K. Jones, Dubuque, IA (US); Kristen Dawn Cadman, Dubuque, IA (US); Erik W. McWethy, Asbury, IA (US); Jaccob Bruce Eichinger, Kaukauna, WI (US)

(73) Assignee: Deere & Company, Moline, IL (US)

( * ) Notice: Subject to any disclaimer, the term of this patent is extended or adjusted under 35 U.S.C. 154(b) by 566 days.

(21) Appl. No.: 15/956,286

(22) Filed: Apr. 18, 2018

(65) Prior Publication Data

US 2019/0323207 A1 Oct. 24, 2019

(51) Int. Cl.

| | |
|---|---|
| ***E02F 9/26*** | (2006.01) |
| ***E02F 9/22*** | (2006.01) |
| ***E02F 9/20*** | (2006.01) |

(52) U.S. Cl.

CPC ..... *E02F 9/268* (2013.01); *E02F 9/2066* (2013.01); *E02F 9/2228* (2013.01); *E02F 9/2235* (2013.01); *E02F 9/265* (2013.01)

(58) Field of Classification Search

CPC ..... E02F 9/268

See application file for complete search history.

(56) References Cited

U.S. PATENT DOCUMENTS

| | | | | |
|---|---|---|---|---|
| 6,493,616 | B1 | 12/2002 | Rossow et al. | |
| 6,708,557 | B2 * | 3/2004 | Moskwa | G01M 15/044 73/116.05 |
| 7,936,261 | B2 * | 5/2011 | Rossaert | E02F 9/267 340/514 |
| 8,532,865 | B2 | 9/2013 | Suzuki et al. | |
| 9,057,174 | B2 | 6/2015 | Uchiyama et al. | |
| 10,208,455 | B2 * | 2/2019 | Fleischmann | B60W 10/10 |
| 2012/0215713 | A1 * | 8/2012 | Moore | E02F 9/267 705/330 |
| 2017/0138018 | A1 | 5/2017 | Beschorner et al. | |
| 2017/0268203 | A1 | 9/2017 | Fleischmann et al. | |
| 2019/0323207 | A1 * | 10/2019 | Jones | E02F 9/2066 |

FOREIGN PATENT DOCUMENTS

DE 202012012697 U1 8/2013

OTHER PUBLICATIONS

German Search Report issued in counterpart application No. 102019205635.0 dated May 4, 2020 (10 pages).

Mecalac, Catalog of pieces de rechange spare parts book spare parts list, 12 MXT Multipurpose vehicle, dated Jan. 2011, pp. 1-282.

Landtreff, Engine stops at hydraulic hydraulics in idle, dated Aug. 2, 2018, pp. 1-6, [online], [retrieved on Apr. 28, 2020]. Retrieved from the Internet <URL: https://www.landtreff.de/motor-geht-aus-bei-hydraulik-betatigung-imstandgas-t125555.html>.

Catalog of pieces de rechange spare parts book spare parts list, 12MXT Multipurpose vehicle, dated Jan. 2011, pp. 1-412.

* cited by examiner

*Primary Examiner* — Michael A Berns

(74) *Attorney, Agent, or Firm* — Joseph R. Kelly; Kelly, Holt & Christenson PLLC

(57) ABSTRACT

An engine on an excavator provides power to a hydraulic pump that pumps hydraulic fluid under pressure to a hydraulic actuator. The hydraulic actuator is controlled to place a load on the engine. Engine response to the load placed on it by the hydraulic actuator is detected and logged. The logged engine response data can be accessed to identify engine response.

20 Claims, 10 Drawing Sheets

EXCAVATOR CONTROL FOR LOAD DELIVERY

FIELD OF THE DESCRIPTION

The present description relates to construction machines. More specifically, the present description relates to controlling one system on an excavator to load another system, for self-testing.

BACKGROUND

There are a wide variety of different types of construction machines. The can include loaders, excavators, dump trucks, among a wide variety of others. These types of machines often operate in relatively remote areas where wireless communication can be difficult. Also, it can be difficult and costly to transport the machines to a facility where they can be tested, in order to address any problems.

These types of machines also often have electronic systems and hydraulic systems. The electronic systems can generate electronic control signals that are used to control functions in the hydraulic system. The hydraulic system illustratively provides hydraulic fluid under pressure, through control valves, to power various actuators (such as hydraulic cylinders, or other hydraulic motors or actuators). The control valves can be pilot valves, in which a pilot pressure is provided to control the position of the hydraulic valves that are used to provide hydraulic fluid under pressure to the hydraulic actuators. The control valves can also be controlled electronically, using a solenoid, in which the solenoid is controlled to move the valve between its open and closed positions.

An engine on the construction machine is often used to provide power to pumps that provide the hydraulic fluid under pressure, in the hydraulic system, from a fluid source (such as a tank). Thus, for instance, when an excavator is performing a digging operation, the bucket of the excavator is controlled to engage material being dug. The pressure needed to move the bucket through that material to perform a digging operation will increase, during portions of the digging operation, and this increases the load on the engine.

Construction machines, such as excavators, can encounter a large number of different types of problems that can affect the power available to the hydraulic actuators. For instance, engine fuel injectors (or other parts of the fuel system) can encounter problems which limit the power that can be delivered by the engine. Also, the hydraulic pump can encounter problems which limits the amount of flow or hydraulic system pressure that can be generated. Various different sensors (that are used in control algorithms to control the engine and the hydraulic system) can become out of calibration or fail. This can also undesirably limit the power that is generated by the engine or that is available to the hydraulic actuators.

The discussion above is merely provided for general background information and is not intended to be used as an aid in determining the scope of the claimed subject matter.

SUMMARY

An engine on an excavator provides power to a hydraulic pump that pumps hydraulic fluid under pressure to a hydraulic system. The hydraulic system is controlled in such a way to place a load on the engine. Engine response to the load placed on it by the hydraulic system is detected and logged.

The logged engine response data can be accessed to identify engine performance characteristics.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

As discussed above, parts of an excavator can encounter problems, which limit the power available to the hydraulic actuators. It can be very difficult to identify the source of such problems. It can be difficult to move the excavator to a facility where it can be tested, and it can also be difficult to controllably load the engine and identify how it responds.

Figure 1:
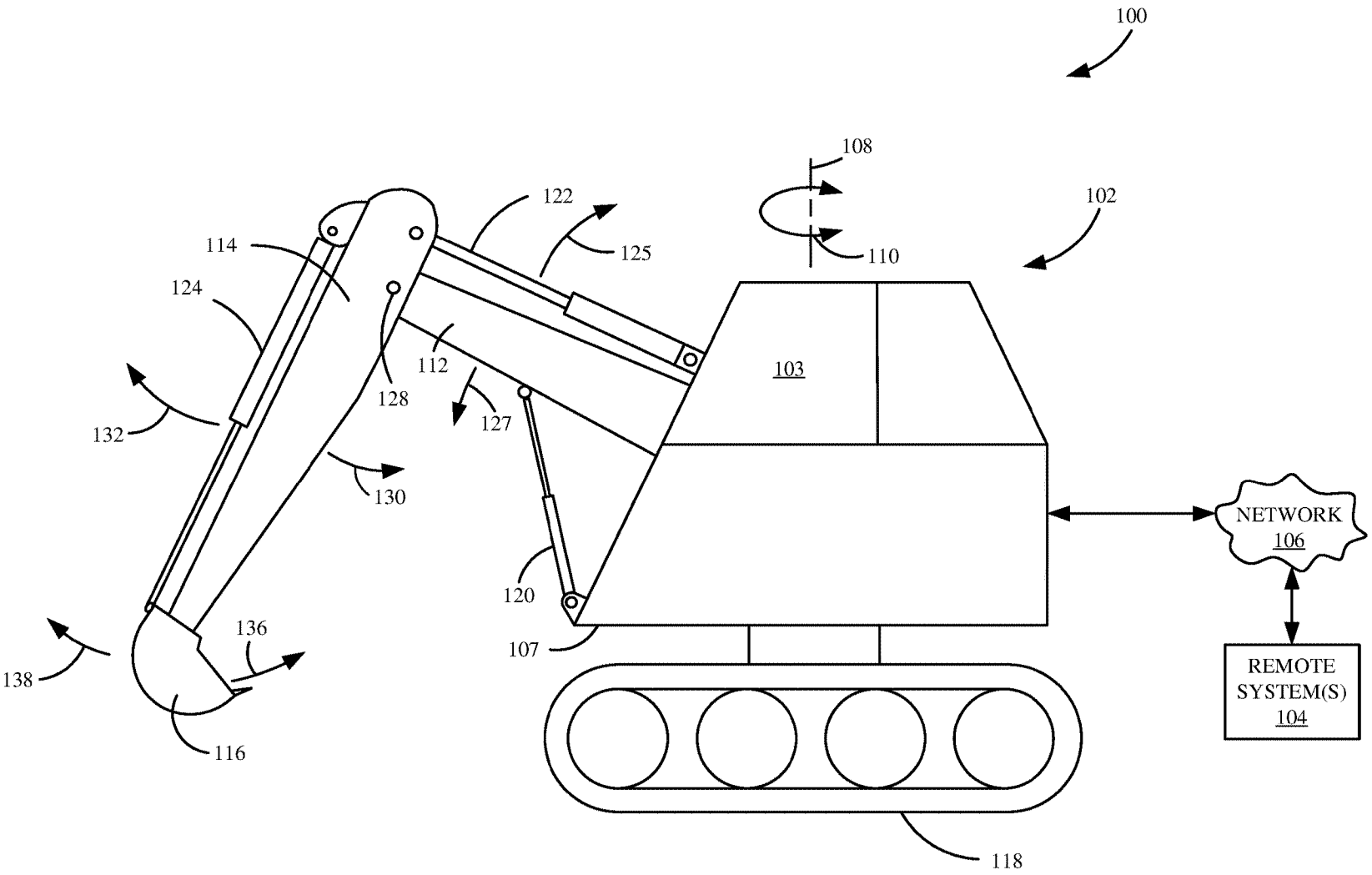
FIG. 1 is a partial pictorial, partial block diagram showing an excavator in an operating architecture.

FIG. 1 is a partial pictorial diagram, partial block diagram, showing one example of an operating architecture 100 that includes a mobile construction machine (in the example shown in FIG. 1, it is an excavator) 102 that can be coupled to one or more remote systems 104 over network 106. Network 106 can be a wide area network, a local area network, a cellular communication network, a nearfield communication network or any other of a wide variety of different networks or combinations of networks. Remote system 104 can be a remote server environment, a project manager's computing system, an engineering test and evaluation computing system, or any other of a wide variety of different remote systems.

In the example shown in FIG. 1, excavator 102 illustratively includes an operator's compartment 103 that sits on a rotatable house 107 that can swing or rotate about axis 108 in the direction indicated by arrow 110. In addition, excavator 102 illustratively has a boom 112 that is pivotally coupled to the house or, operator's compartment 103, an arm 114 that is pivotally coupled to boom 112, and an implement (such as a bucket) 116 that is pivotally coupled to arm 114.

In one example, an engine on excavator 102 provides power to excavator 102. For instance, it can provide power to a propulsion system that can move and steer excavator 102 by driving one or more ground-engaging tracks 118. It also illustratively powers a hydraulic system that provides hydraulic fluid, under pressure, to hydraulic actuators to perform different hydraulic functions. For instance, the hydraulic actuators can include a first actuator 120 that can be extended and retracted to move boom 112 in the directions indicated by arrows 125 and 127, respectively. These functions may be referred to as a boom-up operation and a boom-down operation, respectively.

The hydraulic actuators may also include actuator 122 which can be extended and retracted to pivot arm 114 about a pivot axis 128 to move arm 114 in the direction indicated by arrows 130 (to perform an arm-in operation) and 132 (to perform an arm-out operation). Similarly, the hydraulic actuators can include actuator 124 that can be extended and retracted to move bucket 116 generally in the direction indicated by arrows 136 and 138, respectively. When bucket 116 is moved in the direction indicated by arrow 136, this can be referred to as a loading operation and when it is moved in the direction indicated by arrow 138, this can be referred to as a dumping operation.

Figure 2:
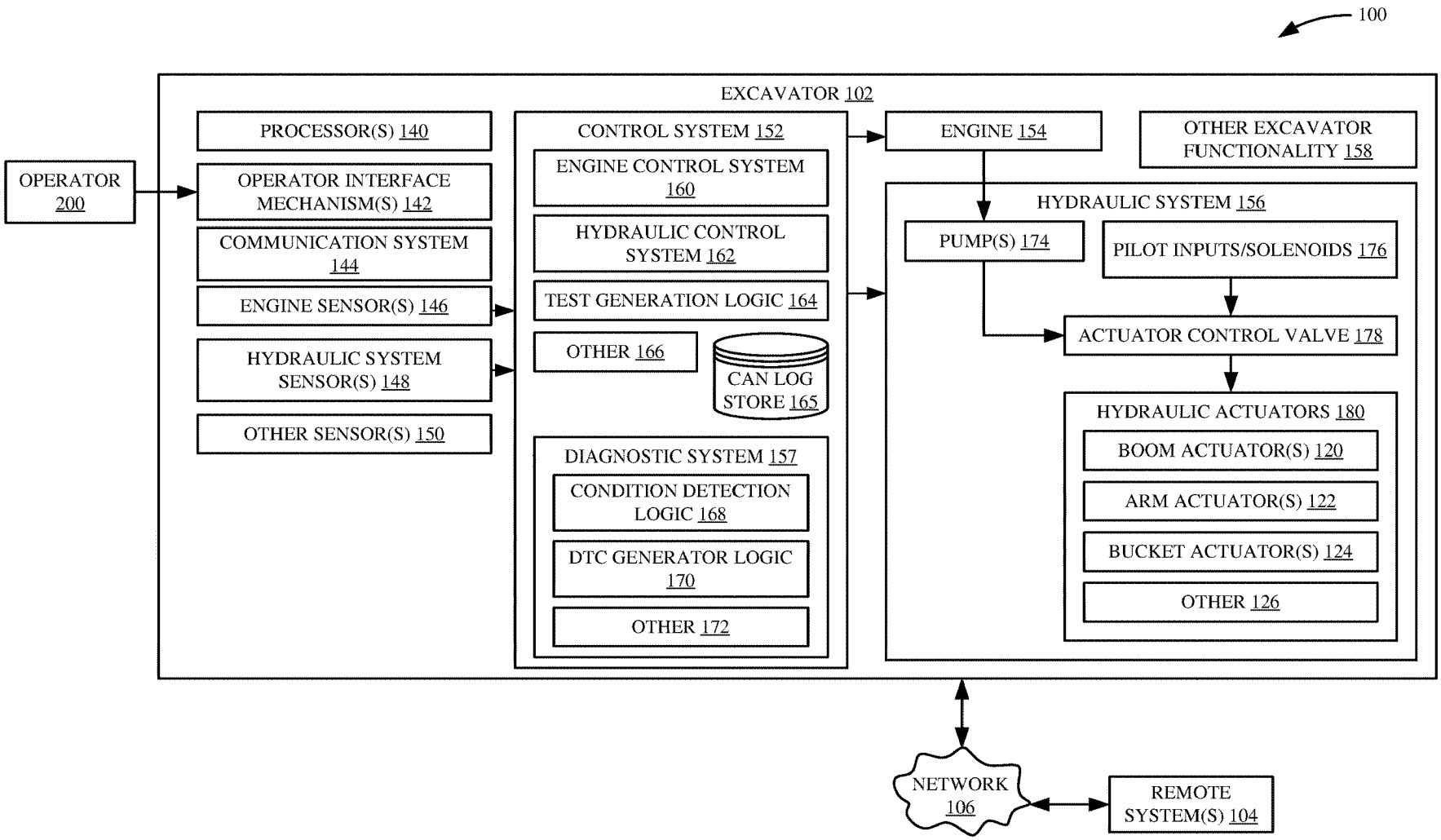
FIG. 2 is a block diagram showing the architecture illustrated in FIG. 1, with the excavator illustrated in more detail.

FIG. 2 is a block diagram showing architecture 100, illustrated in FIG. 1, with portions of excavator 102 shown in more detail. In the example shown in FIG. 2, excavator 102 can include one or more processors 140, one or more operator interface mechanisms 142, communication system 144, a plurality of different engine sensors 146, a plurality of different hydraulic system sensors 148, and a wide variety of other sensors 150. Excavator 102 also illustratively includes control system 152, engine 154, hydraulic system 156, diagnostic system 157, and it can include a wide variety of other excavator functionality 158. Control system 152 can include engine control system 160, hydraulic control system 162, test generation logic 164, CAN log data store 165 and it can include other items 166.

Diagnostic system 157 can include condition detection logic 168, diagnostic trouble code (DTC) generator logic 170, and it can include other items 172.

Hydraulic system 156 can include one or more pumps 174, pilot valves or solenoids 176, actuator control valves 178, and hydraulic actuators 180. In the example illustrated in FIG. 2, hydraulic actuators 180 can include boom actuator 120, arm actuator 122 and bucket actuator 124 (all of which are shown in FIG. 1) among a wide variety of other actuators 126. Before describing the overall operation of excavator 102 in loading itself to perform a self-test, a brief description of some of the items in excavator 102, and their operation, will first be provided.

Operator interface mechanisms 142 can include a wide variety of different operator interface mechanisms that operator 200 can interact with to control and manipulate excavator 102. For instance, they can include joysticks, levers, pedals, buttons, a display screen, touch sensitive display elements, other visual, audio and haptic systems, among others. In addition, they can include a microphone, where speech recognition components are included.

CAN log data store 165 can be used to store CAN messages indicative of certain conditions. This is discussed in greater detail below. Also, while the present description proceeds with respect to a CAN log it will be noted that recording any kind of network traffic (such as a local interconnection network-LIN, RS2323, etc.) is contemplated herein and CAN is just one example.

Communication system 144 illustratively allows for items on excavator 102 to communicate with one another, and to communicate over network 106 with remote systems 104. Therefore, communication system 144 can be a system that facilities communication over a controller area network—CAN-bus, a cellular communication system, a wide area network communication system, or any other type of communication system that can be used to communicate over network 106 and within excavator 102.

Engine sensors 146 can sense a wide variety of different types of variables indicative of the performance of engine 154. Engine sensors 146 can include, for instance, an engine speed sensor that senses the speed of engine 154 (which can be used to tell whether it is running or not running). Engine sensors 146 can also sense a wide variety of other variables. Hydraulic system sensors 148 can sense the pump pressure output by pumps 174, the pilot pressure applied to pilot inputs 176, displacement sensors that sense the displacement of pump 174, other flow and/or pressure sensors, solenoid sensors that sense the position of solenoid 176 in solenoid-control valves, hydraulic oil temperature, hydraulic oil level, among a wide variety of other things.

These sensors can include a wide variety of other sensors 150 as well. Such sensors can sense or detect the position of various operator interface mechanisms 142 (such as the position of joysticks or levers, etc.), air filter sensors (which may be, for instance, a switch) that sense air flow through an air filter to determine whether the air filter is clogged, and electric power sensors which sense the voltage level of switched power generated by control system 152 (such as the volts available on a switched power supply in excavator 102). In addition, engine control system 160 can receive other information as well, such as a mode input which indicates the particular power mode which excavator 102 is in (such as a high power mode, an economy mode, etc.), and the work mode that excavator 102 is in (such as dig, crane, etc.). Other sensor inputs can indicate what the throttle is set to (e.g., an engine speed corresponding to the throttle position or throttle dial position), whether the air conditioning (or other HVAC components) are on or off, among others.

Engine control system 160 generates control signals to control engine 154 based on operator inputs through operator interface mechanisms 142, based on sensor inputs, based on inputs from test generation logic 164, etc. For instance, engine control system 160 may detect a particular load that is being requested by hydraulic control system 162 and control the speed of engine 154 accordingly. By way of example, it may be that engine 154 can be placed in an automatic acceleration mode in which the engine speed is controlled to vary with the load placed on the engine by various components of excavator 102. In that case, when hydraulic control system 162 is commanding pumps 174 for a high flow rate, this can be indicated to engine control system 160 which then controls engine 154 to increase engine speed so that the available power (e.g., flow, pressure, etc.) can be provided by pumps 174.

Hydraulic control system 162 illustratively controls hydraulic system 156 based on operator inputs through operator interface mechanisms 142, based upon the sensor inputs from the various sensors, and based upon input signals from test generation logic 164. For instance, hydraulic control system 162 can control pumps 174 to increase or decrease their displacement (and thus the flow through them). It can control pilot inputs or solenoids 176 (which control the position of the actuator power valves) to perform functions with the hydraulic actuators 180. It can control other hydraulic components as well.

Pumps 174 are illustratively used to pump hydraulic fluid (e.g., to pressurize it) and provide it to actuator control valves 178. The position of each of valves 178 is controlled by a pilot input or solenoid 176. When actuator control valves 178 are opened, they provide hydraulic fluid under pressure from pump 174 to hydraulic actuators 180 in order to perform functions or operations with actuators 178. For instance, when the actuator power valve corresponding to the boom actuator 120 is opened, it provides hydraulic fluid under pressure to boom actuator 120 to extend or retract, it based upon a control input. The same is true for arm actuators 122, bucket actuators 124 and any other hydraulic actuators 126. Thus, hydraulic control system 162 can generate control signals to control the displacement of pump 174 and to control pilot inputs or solenoids 176 which, in turn, control the position of the actuator control valves 178 which provide hydraulic fluid under pressure to hydraulic actuators 180.

Test generation logic 164 illustratively controls excavator 102 so that it can perform a self-test. By way of example, logic 164 (which is described in greater detail below with respect to FIG. 3) can generate control signals and provide them to hydraulic control system 162. In turn, hydraulic control system 162 can control hydraulic actuators 180 so that they place a load on engine 154. Engine sensors 146 can then be used to detect the response of engine 154 to that load so that the health of engine 154, and its performance, can be identified. Similarly, hydraulic system sensors 148 can be used to detect the operation of hydraulic system 156 in applying the load.

In one example, test generation logic 164 applies a load profile in which it provides signals to engine control system 160 so that engine control system 160 maintains the speed of engine 154 at a preset level (or maintains the throttle or dial position at a preset position). It then varies the hydraulic load generated by hydraulic control system 162 so that engine sensors 146 and hydraulic system sensors 148 can detect the response of engine 154 and hydraulic system 156 to the varying hydraulic load. In another example, test generation logic 164 applies a test profile in which it provides signals to hydraulic control system 162 to control actuators 180 to apply a fixed load to engine 154, and then test generation logic 164 provides signals to engine control system 160 so that system 160 varies the engine speed of engine 154. Again, engine sensors 146 and hydraulic system sensors 148 can be used to detect the reaction of engine 154 to the fixed load, and to the input commands that vary the engine speed. They can also illustratively be used to detect the performance of hydraulic system 156 in maintaining the fixed load.

Diagnostic system 157 illustratively receives sensor inputs from some or all of the sensors, and uses condition detection logic 168 to detect when any diagnostic trouble conditions exist. When they do, system 157 uses DTC generator logic 170 to generate one or more diagnostic trouble codes that can be surfaced to operator 200 through operator interface mechanisms 142. They can be stored in a data store (e.g., a CAN log) for later analysis. They can be communicated to one or more remote systems 104, or they can be handled in other ways.

Figure 3:
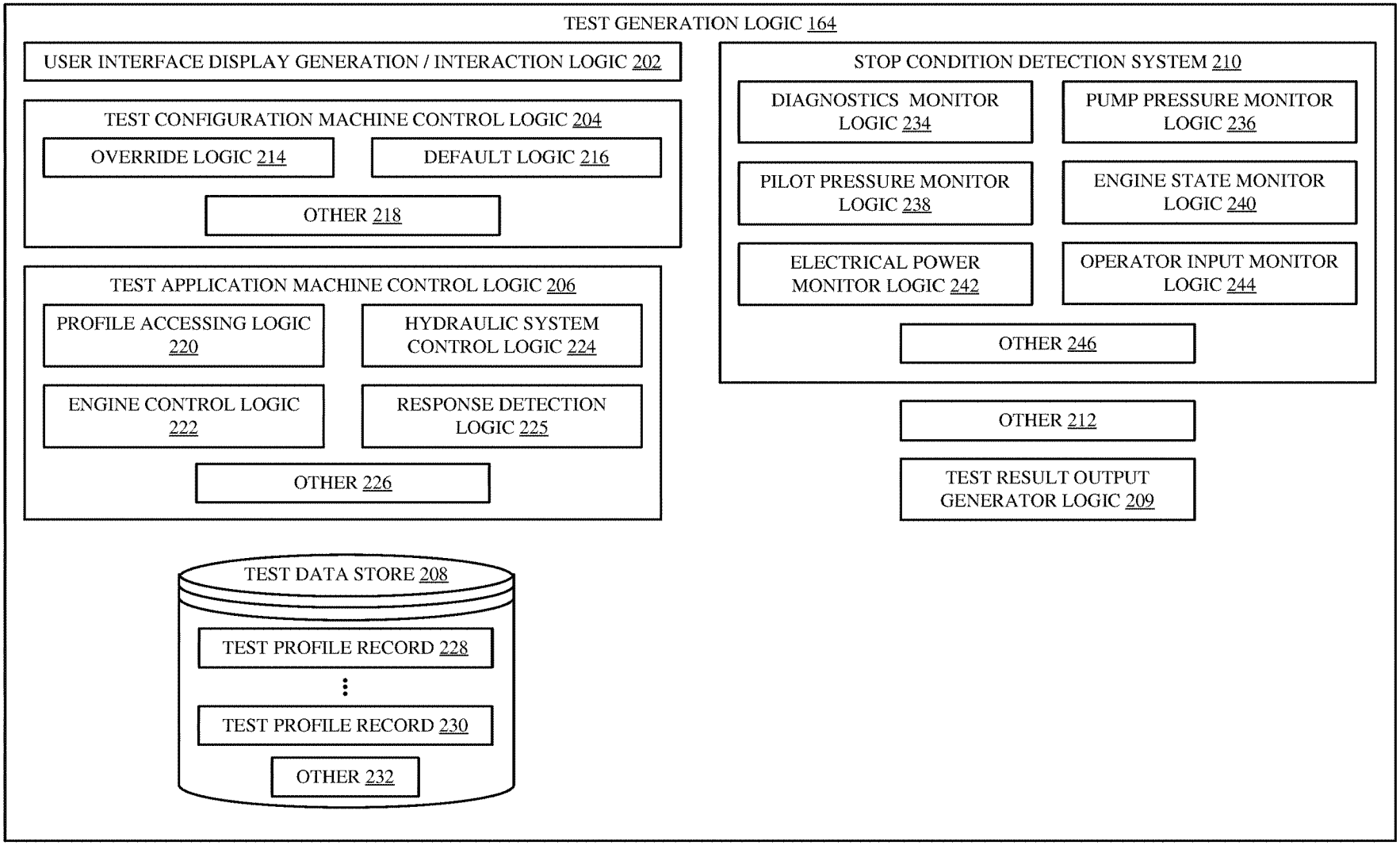
FIG. 3 is a block diagram showing one example of test generation logic in more detail.

FIG. 3 is a block diagram showing one example of test generation logic 164, in more detail. Test generation logic 164 illustratively includes user interface display generation/interaction logic 202, test configuration machine control logic 204, test application machine control logic 206, test data store 208, test results output generator logic 209, stop condition detection system 210, and it can include other items 212. Test configuration machine control logic 204 illustratively includes override logic 214, default logic 216, and it can include other items 218. Test application machine control logic 206 illustratively includes profile accessing logic 220, engine control logic 222, hydraulic system control logic 224, response detection logic 225, and it can include other items 226. Test data store 208 can illustratively include a set of test profile records 228-230, each of which defines a test profile that can be applied to the machine 102 by test application machine control logic 206. Data store 208 can include other items 232 as well.

Stop condition detection system 210 illustratively includes diagnostics monitor logic 234, pump pressure monitor logic 236, pilot pressure monitor logic 238, engine state monitor logic 240, electrical power monitor logic 242, operator input monitor logic 244, and it can include other items 246. Some of the items in test generation logic 164, and their operation, will now be described in more detail.

User interface display generation/interaction logic 202 is illustratively used to control user interface displays in operator interface mechanisms 142 (shown in FIG. 2) and to detect user interaction with those displays. For instance, logic 202 can detect that a user has provided an input indicating that the user wishes the machine to run a self-test.

Test configuration machine control logic 204 then controls excavator 102 to place it in a proper configuration or mode for the test to be run. Override logic 214 illustratively takes control of various input parameters and overrides previous values to place the machine in the proper condition. Default logic 216 can be used to return those inputs to their default values after the test is run.

Test application machine control logic 206 then uses profile accessing logic 220 to retrieve a test profile record from test data store 208 and applies the test profile to the machine, based upon that test profile record. Therefore, profile accessing logic 220 illustratively accesses test data store 208 to obtain a test profile record (such as record 228) which defines a test profile (or load profile) that is to be run on the machine. Engine control logic 222 provides signals to engine control system 160 so that it controls engine 154 based upon the particular test profile being run. Hydraulic system control logic 224 generates signals and provides them to hydraulic control system 162 so that it controls hydraulic system 156 based on the test profile being run.

Stop condition detection system 210 detects any conditions which would cause the test to stop. It can detect these conditions by monitoring sensor signal values or in other ways. Diagnostics monitor logic 234 illustratively monitors any diagnostic trouble codes that are generated by DTC generator logic 170 and diagnostic system 157 (shown in FIG. 2). The test may be stopped, for instance, when a diagnostic code is generated, and relates to a pilot pressure sensor, a pump pressure sensor, a pump solenoid, any of the engine sensors, an air filter restriction sensor, a hydraulic oil parameter sensor, or other DTCs.

Pilot pressure monitor logic 238 can monitor the pilot pressure provided to various pilot-controlled valves (using hydraulic system sensors 148) to determine whether the pilot pressure on the various pilot valves is maintained at a desired level. For instance, assume that arm actuator 122 is to be controlled to perform an arm in operation, based on the retrieved test profile, in order to exert a load on engine 154. In that case, the pilot pressure monitor logic 238 can monitor the pilot pressure on the pilot input 176 used to control the actuator power valve 178 that provides hydraulic fluid under pressure to arm actuator 122. If that pilot pressure falls below a certain level, this may indicate that the arm is no longer performing the desired operation, and this can be used to stop the test. In another example, if the pilot pressure on other pilot inputs 176 is outside of a neutral range, this may indicate that other valves are being actuated, which should not be actuated during the test, and this condition can stop the test as well.

Pump pressure monitor logic 236 can illustratively monitor the output pressure by pumps 174 to ensure that pressure is maintained within a desired range. If it moves outside of that range, this can be used to stop the test as well.

Engine state monitor logic 240 can be used to monitor the state of the engine 154 to detect whether engine 154 is running. For instance, if the engine speed drops below a threshold speed, this may indicate that the engine 154 is no longer running. If the engine state changes from "running" to "not running", then this can be used to stop the test.

Electric power monitor logic 242 can be used to monitor the level of electric power being generated by one or more different power supplies on excavator 102. If those power levels move outside of a desired voltage range, for instance, then this can be used to stop the test as well.

Similarly, operator input monitor logic 244 can monitor whether the operator has provided an input indicating that the operator wishes to stop the test. For instance, it may be that the operator touches a "cancel" button or "exit" button indicating that the operator wishes to stop the test. In any of these scenarios, the test can be stopped as well.

It will be noted that the various logic discussed above with respect to stop condition detection system 210 are discussed for the sake of example only. A wide variety of additional or different conditions can be monitored or detected and used to stop the test as well. Those discussed are mere examples.

Figure 4:
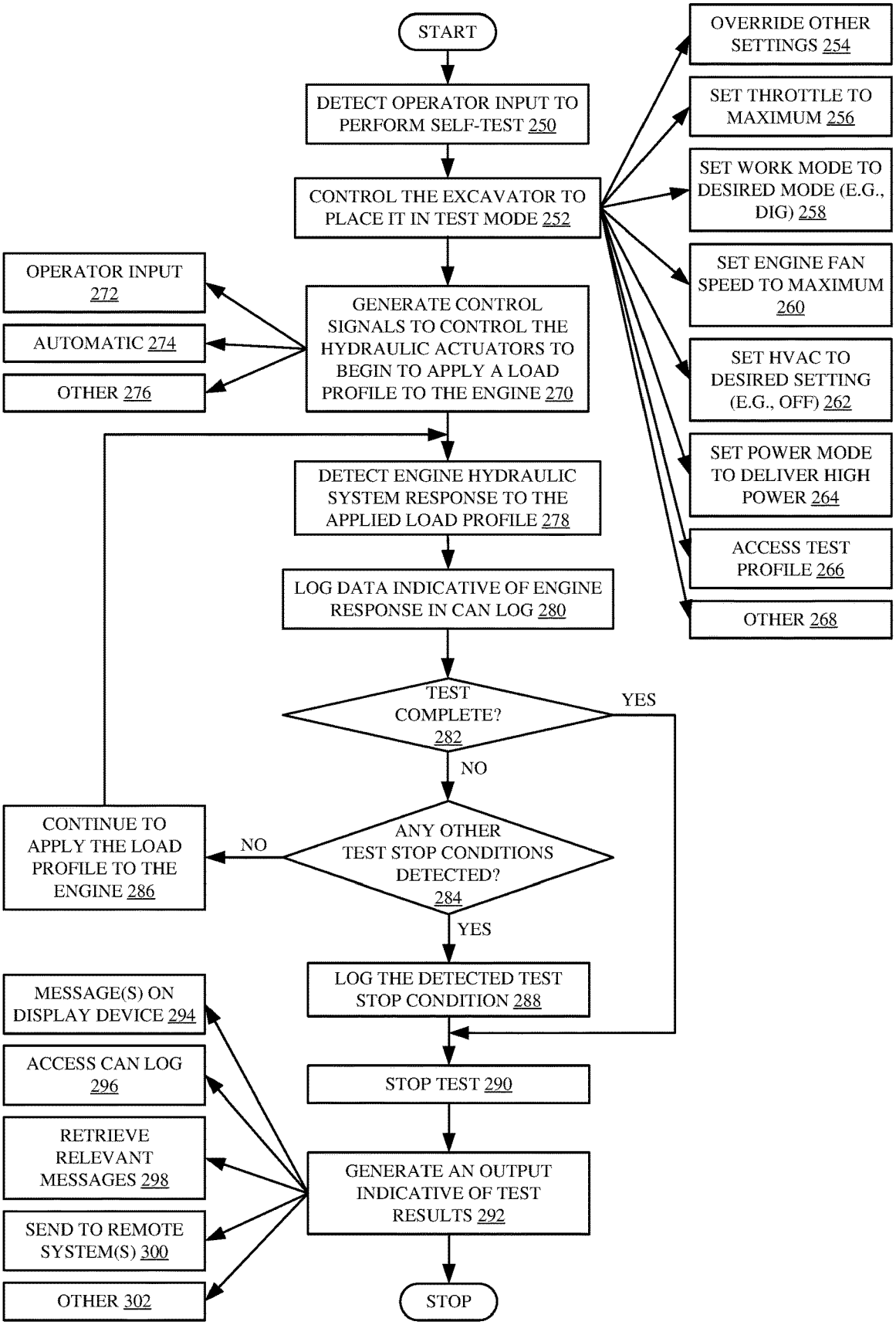
FIG. 4 is a flow diagram illustrating one example of the overall operation of the excavator in controlling a hydraulic system to load an engine in the excavator.

FIG. 4 is a flow diagram illustrating one example of the operation of test generation logic 164, and excavator 102, in performing a self-test. It is first assumed that one or more test profile records 228-230 have been loaded into test generation logic 164. In one example, this can be done ahead of time. In another example, they can be downloaded from (or accessed on) a remote server environment, or another remote system 104, when it is desired to run a test.

Figure 4A:
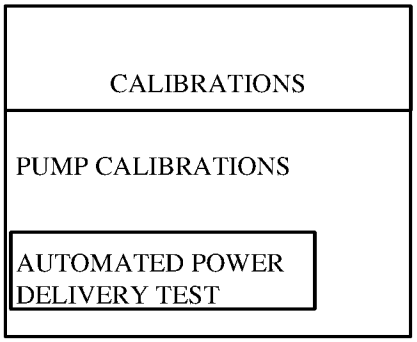
FIGS. 4A-4D are example user interface displays.

User interface display generation/interaction logic 202 then detects an operator input indicating that operator 200 wishes to have the machine perform a test. This is indicated by block 250 in the flow diagram of FIG. 4. Examples of different user interfaces that can be generated by user interface display/interaction logic 202 and are shown in FIGS. 4A-4D. In FIG. 4A, it can be seen that the operator has navigated to a "calibrations" screen where an option is provided (a user actuatable interface display element) to run "automated power delivery test". The operator has actuated that actuatable user interface display element, and this is detected by logic 202. The operator is then navigated to a display such as that shown in FIG. 4B where a set of different tests can be selected by the operator. In the example shown in FIG. 4B, the operator has selected "step test".

Figure 4B:
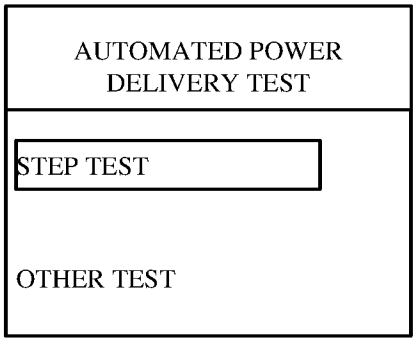
Figure 4C:
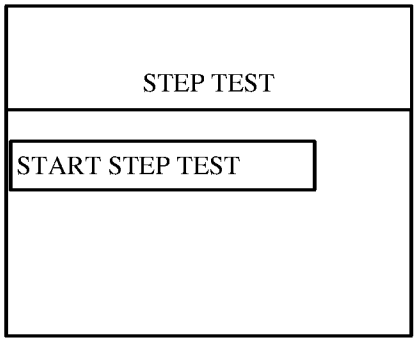

The operator is then navigated to a display such as that shown in FIG. 4C, where the operator is offered an actuatable display element that can be actuated to start the selected test (e.g., the "step test"). When the operator actuates that user actuatable element, test configuration machine control logic 204 (shown in FIG. 3) controls excavator 102 to place it in a proper configuration or in a proper state for the test to be run. This is indicated by block 252 in the flow diagram of FIG. 4. In one example, override logic 214 is used to override any other settings that may have been input. Overriding other settings is indicated by block 254. Logic 214 can be used to set the throttle (or throttle dial) to a desired level (such as the maximum level) as indicated by block 256. Logic 214 can be used to set the work mode to a desired mode (such as the dig mode). This is indicated by block 258. Logic 214 can be used to set the engine fan speed to a desired level (such as its maximum level). This is indicated by block 260. Logic 214 can be used to set the HVAC to a desired setting (such as to turn off the air conditioner or other HVAC elements). This is indicated by block 262. Logic 214 can be used to set the power mode to deliver a high power, so that engine 154 can be adequately tested. This is indicated by block 264.

Profile accessing logic 220 can then be used to access the test profile record in test data store 208 that corresponds to the test selected by the operator in FIG. 4B. Accessing the test profile is indicated by block 266. Test configuration machine control logic 204 can be used to control excavator 102 to place it in a desired test state in other ways as well, and this is indicated by block 268.

Figure 4D:
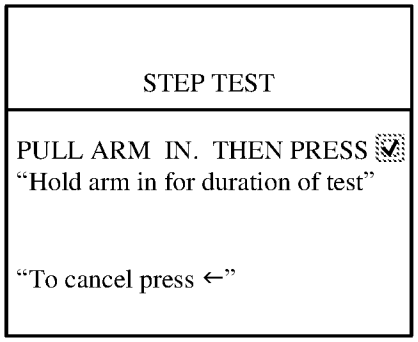

Test application machine control logic 206 then controls the machine so that it loads itself according to the test profile in the retrieved test profile record. In one example, hydraulic system control logic 224 generates signals to hydraulic control system 162 so that it controls hydraulic system 156 to begin to apply a load defined by the test profile to engine 154. This is indicated by block 270. This can be done in a number of different ways. For example, the operator 200 can be instructed to control actuation of one or more of the hydraulic actuators 180 in order to apply the load. This is indicated by block 272, and one example of this is shown in FIG. 4D. FIG. 4D shows a user interface display which instructs the operator to control the arm actuator 122 to perform an arm in operation so that arm 114 moves inwardly as indicated by arrow 130 (in FIG. 1), until it reaches the maximum extent of travel of arm actuator 122. When this happens, continuing to control actuator 122 to apply force, even against a mechanical stop or other limiter which limits further travel of arm 114 inwardly, exerts an additional load on engine 154.

In another example, the arm actuator 122 can be controlled automatically to exert the load (or another actuator can be controlled automatically). Automatically exerting the load is indicated by block 274 in the flow diagram of FIG. 4. Control signals can be generated to control the hydraulic actuators to begin to apply the load profile to engine 154 in other ways as well, and this is indicated by block 276.

Response detection logic 225 then detects the engine response to the applied load profile. This is indicated by block 278. In one example, the engine responses are captured in various CAN messages that are generated based on sensor inputs or other inputs, and that are stored in the CAN log data store 165. Again, CAN is described for the sake of example only, and other network traffic can be captured as well. In other examples, response detection logic 225 can be a separate set of logic that separately acquires CAN messages or other sensor signals that are indicative of the response of the engine 154 or hydraulic system 156, or both. By way of example, it may be that the load profile is applied in a stepped fashion (as will be described in greater detail below with respect to FIG. 5). In that case, the engine response may include data indicative of the speed at which the engine 154 accelerates in response to the applied load, the amount of overshoot or undershoot by engine 154, the ability of the engine 154 to generate maximum power to pumps 174, among other things.

The data indicative of the engine response is then saved or logged. In one example, it is saved in CAN log store 165. This is indicated by block 280 in the flow diagram of FIG. 4.

Test application machine control logic 206 then determines whether the test is complete. This is indicated by block 282. If not, then it determines whether stop condition detection system 210 has detected any other stop conditions under which the test should be stopped. This is indicated by block 284. If not, then test application machine control logic 206 continues to apply the load as indicated by the load profile, to engine 154. This is indicated by block 286. Again, as an example, hydraulic system control logic 224 illustratively generates signals to hydraulic control system 162 so that it controls hydraulic system 156 to place a load on engine 154. Processing then reverts to block 278 where the engine response is detected.

If, at block 284, it is determined that stop condition detection system 210 has detected a stop condition, then test application machine control logic 206 logs the detected test stop condition as indicated by block 288. It then stops the test. Also, if the test is complete as indicated by block 282, it stops the test as well. This is indicated by block 290.

Test result output generator logic 209 then generates an output indicative of the test results. This is indicated by block 292. For example, it can control operator interface mechanisms 142 to generate a display message on a display device for operator 200. This is indicated by block 294. It can access the CAN log 165 and aggregate CAN messages that are indicative of the test results. This is indicated by block 296. It can retrieve any relevant CAN messages and aggregate them as results as well. This is indicated by block 298. Test result output generator logic 209 can also control communication system 144 to send the test results to one or more remote systems 104. This is indicated by block 300. It can generate an output indicative of the test results in other ways as well, and this is indicated by block 302.

Figure 5:
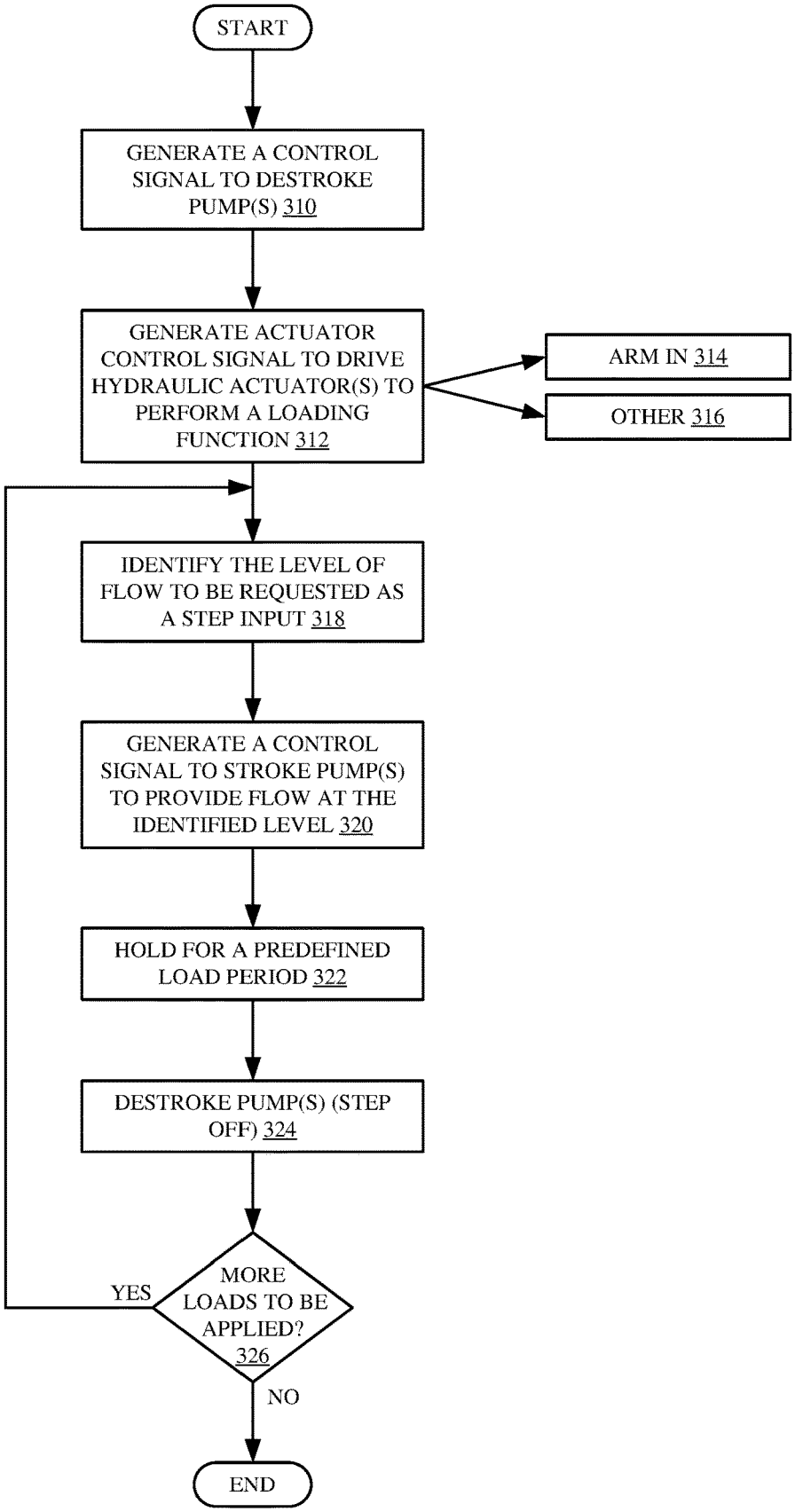
FIG. 5 is a flow diagram illustrating one example of the operation of the excavator in applying a load profile.

FIG. 5 is a flow diagram showing one example of how a particular test profile is applied by test application machine control logic 206. In the example shown in FIG. 5, the test profile specifies that a varying load is to be applied to engine 154, while engine 154 is set to run at a fixed engine speed (or where the engine speed dial is set to a fixed level, and engine 154 is controlled in an auto acceleration mode).

Figure 5A:
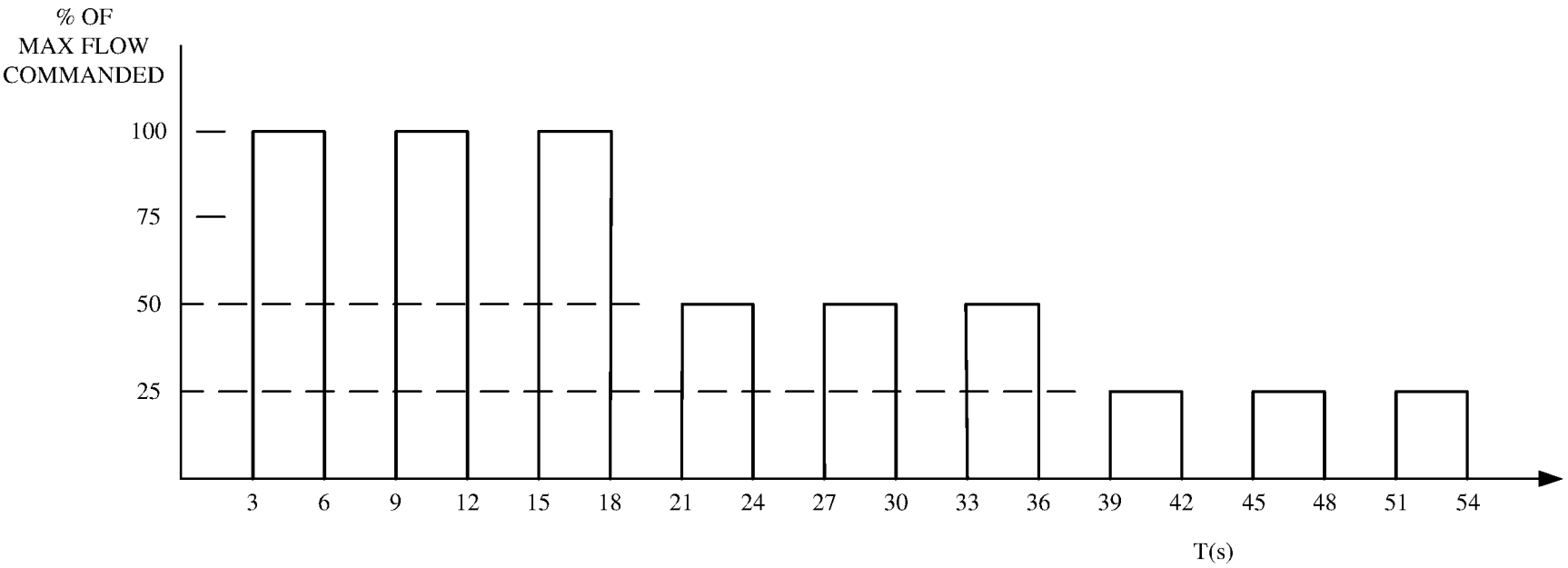
FIG. 5A is a graphical illustration of one example of a load profile.

FIG. 5A is a graph illustrating one example of such a test profile. The x-axis plots time in seconds and the y-axis plots the percent of maximum flow that will be commanded at pump 174. For instance, when pump 174 is fully destroked, then the commanded flow is at zero percent. Where it is fully stroked, then the commanded flow is at one hundred percent. It can be seen that, according to the test profile shown in FIG. 5A, the pump is commanded to its stroked position three separate times (or phases), for three seconds each, at three different loads or percentages. Each of these stroked phases is commanded as a step input. At the end of each of these phases, the pump is fully destroked, again as a step input in the negative direction. This is repeated three separate times at the one hundred percent level. The pump is then stroked to fifty percent of its maximum level three times, again provided as a step input and separated by three seconds during which the pump is fully destroked. The pump is then stroked to twenty-five percent of its maximum level three times, again provided as a step input and separated by three fully destroked phrases. The response of engine 154 to this test profile is illustratively detected and logged. It can be seen in the test profile shown in FIG. 5A that the set speed for engine 154 is not varied.

Using this type of test profile, hydraulic system control logic 224 first generates a control signal and provides it to hydraulic control system 162 which causes hydraulic control system 162 to destroke pumps 174, placing them in a known, destroked state. Destroking the pumps is indicated by block 310 in the flow diagram of FIG. 5.

Logic 224 then generates signals and provides them to hydraulic control system 162 so that hydraulic control system 162 controls hydraulic system 156 to generate an actuator control signal to drive one or more hydraulic actuators 180 to perform a loading function (a function where they place a load on engine 154). This is indicated by block 312. Again, this can be performed automatically, or operator 200 can be instructed to do this, or otherwise. In one example, the loading function is an arm in function 314, where the control lever is continuously held in the arm in position so that arm actuator 122 exerts a load on engine 154. Of course, the loading function can be another type of hydraulic function as well, and this is indicated by block 316.

Hydraulic control system 162 then identifies the level of flow that will be needed from pump 174 to perform the loading function. This is indicated by block 318. It then generates a control signal to stroke pump 174 to provide the flow at the identified level. This is indicated by block 320. This state is held for a predefined load period (such as three seconds as discussed above with respect to FIG. 5A), as indicated by block 322. After the predefined load period, hydraulic control system 162 again controls pump 174 to destroke the pump (or to provide a step input, turning off pump 174). This is indicated by block 324.

Test application machine control logic 206 then determines whether there are more loads to be applied to engine 154 according to this load profile. This is indicated by block 326. If so, processing reverts to block 318 where the amount of flow needed to apply the next step input is determined, and where it is then commanded. It will be noted that there can be a wide variety of different types of test profiles.

Figure 6:
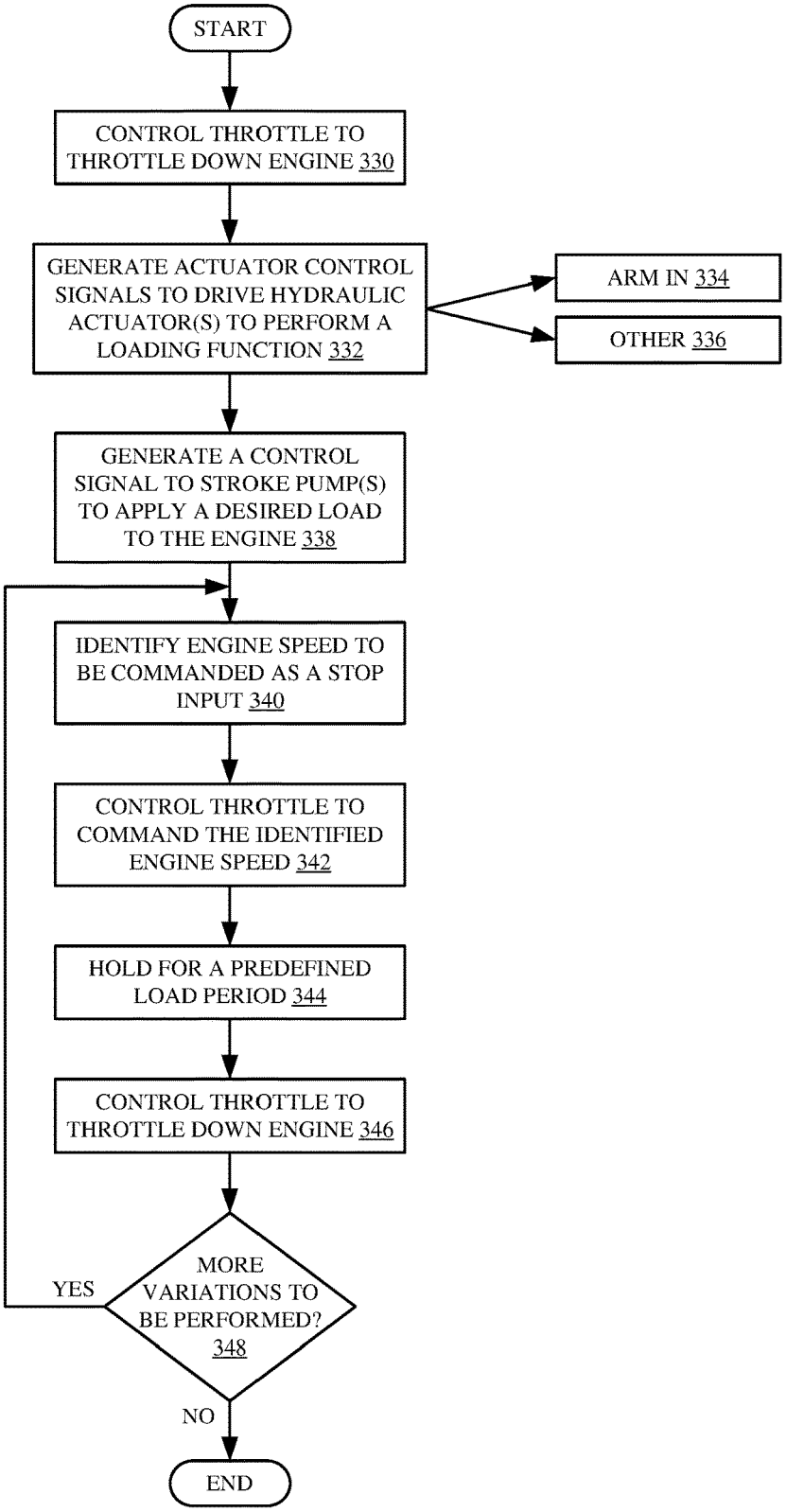
FIG. 6 is a flow diagram illustrating one example of the operation of the excavator in applying a load profile.

FIG. 6 is a flow diagram in which test application machine control logic 206 applies a different load profile to excavator 102 than that shown and described above with respect to FIGS. 5 and 5A. The profile applied in FIG. 6 is one in which the hydraulic system 156 is controlled so that the hydraulic load is fixed, but the engine speed is varied under that load. Thus, engine control logic 222 first generates control signals and provides them to engine control system 160 to throttle down engine 154. This is indicated by block 330 in the flow diagram of FIG. 6. The engine can be throttled down to a predetermined rpm.

Hydraulic system control logic 224 then generates signals and provides them to hydraulic control system 162 so that system 162 generates actuator control signals to drive one or more hydraulic actuators 180 to perform a loading function which loads the engine 154. This is indicated by block 332. Again, the loading function can be an arm in function 334, or another function 336. Hydraulic system control logic 224 then generates signals and provides them to hydraulic control system 162 to fully stroke pump 174 (or to apply another desired load to the engine 154). This is indicated by block 338. Engine control logic 222 then identifies an engine speed (based upon the test profile being applied) to be commanded as a step input to engine 154. This is indicated by block 340. Logic 224 then generates signals and provides them to engine control system 160 to control the throttle to command the identified engine speed for engine 154. This is indicated by block 342. This engine speed is then held for a predefined load period as indicated by block 344, and engine control system 160 is then controlled to throttle down the engine 154. This is indicated by block 346. Test application machine control logic 206 then determines whether there are more variations to be performed in applying the test profile. This is indicated by block 348. If so, then processing reverts to block 340 where the next engine speed to be applied as a step input is identified and applied to the engine 154. This continues until the entire load profile has been run, or until another stop condition is detected.

The present discussion has mentioned processors and servers. In one example, the processors and servers include computer processors with associated memory and timing circuitry, not separately shown. They are functional parts of the systems or devices to which they belong and are activated by, and facilitate the functionality of the other components or items in those systems.

Also, a number of user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the Figures show a number of blocks with functionality ascribed to each block. It will be noted that fewer blocks can be used so the functionality is performed by fewer components. Also, more blocks can be used with the functionality distributed among more components.

Figure 7:
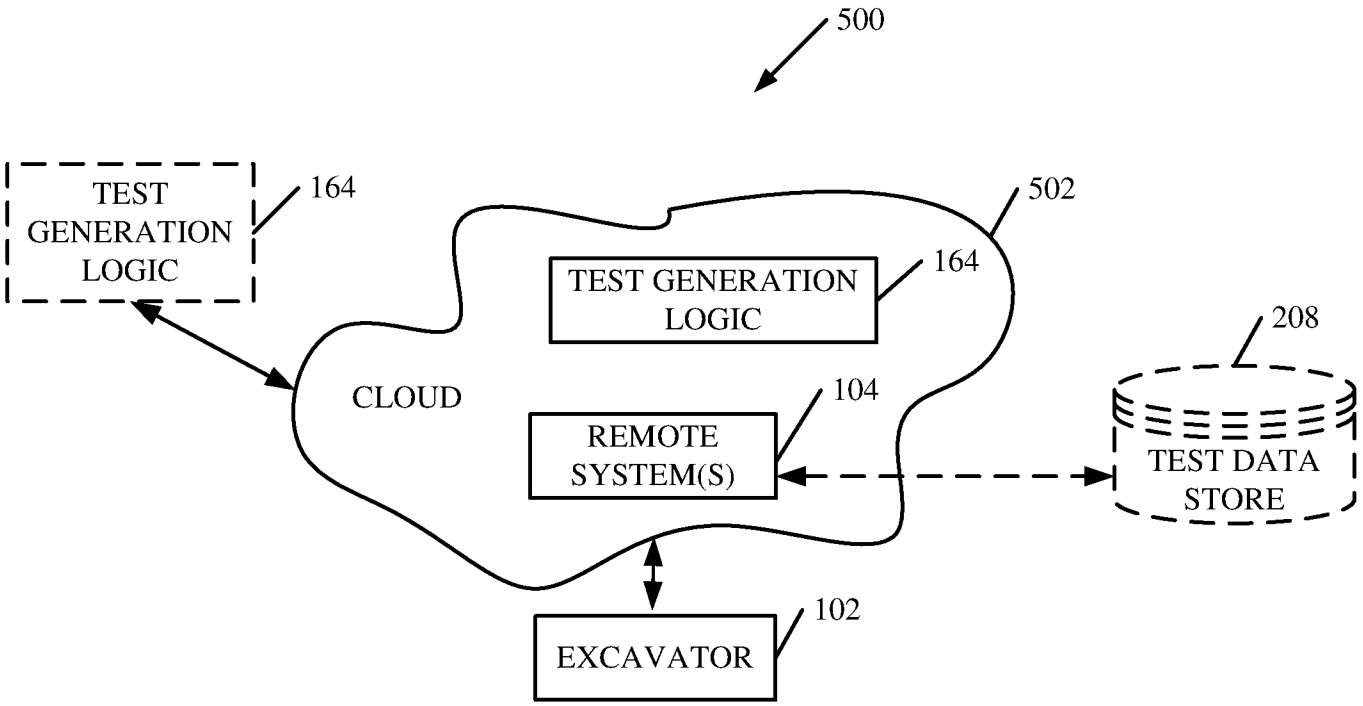
FIG. 7 is a block diagram showing one example of the architecture illustrated in FIG. 1, deployed in a remote server architecture.

FIG. 7 is a block diagram of excavator 102, shown in FIG. 2, except that it communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in FIG. 2 as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the example shown in FIG. 7, some items are similar to those shown in FIG. 2 and they are similarly numbered. FIG. 7 specifically shows that remote systems 104, test generation logic 164 and/or test data store 208 can be located at a remote server location 502. Therefore, excavator 102 accesses those systems through remote server location 502.

FIG. 7 also depicts another example of a remote server architecture. FIG. 7 shows that it is also contemplated that some elements of FIG. 2 can be disposed at remote server location 502 while others are not. By way of example, test generation logic 164 or test data store 208 can be disposed at a location separate from location 502, and accessed through the remote server at location 502. Regardless of where they are located, they can be accessed directly by excavator 102, through a network (either a wide area network or a local area network), they can be hosted at a remote site by a service, or they can be provided as a service, or accessed by a connection service that resides in a remote location. Also, the data can be stored in substantially any location and intermittently accessed by, or forwarded to, interested parties. For instance, physical carriers can be used instead of, or in addition to, electromagnetic wave carriers. In such an example, where cell coverage is poor or nonexistent, another mobile machine (such as a fuel truck) can have an automated information collection system. As the excavator comes close to the fuel truck for fueling, the system automatically collects the information from the excavator using any type of ad-hoc wireless connection. The collected information can then be forwarded to the main network as the fuel truck reaches a location where there is cellular coverage (or other wireless coverage). For instance, the fuel truck may enter a covered location when traveling to fuel other machines or when at a main fuel storage location. All of these architectures are contemplated herein. Further, the information can be stored on the excavator until the excavator enters a covered location. The excavator, itself, can then send the information to the main network.

It will also be noted that the elements of FIG. 2, or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 8:
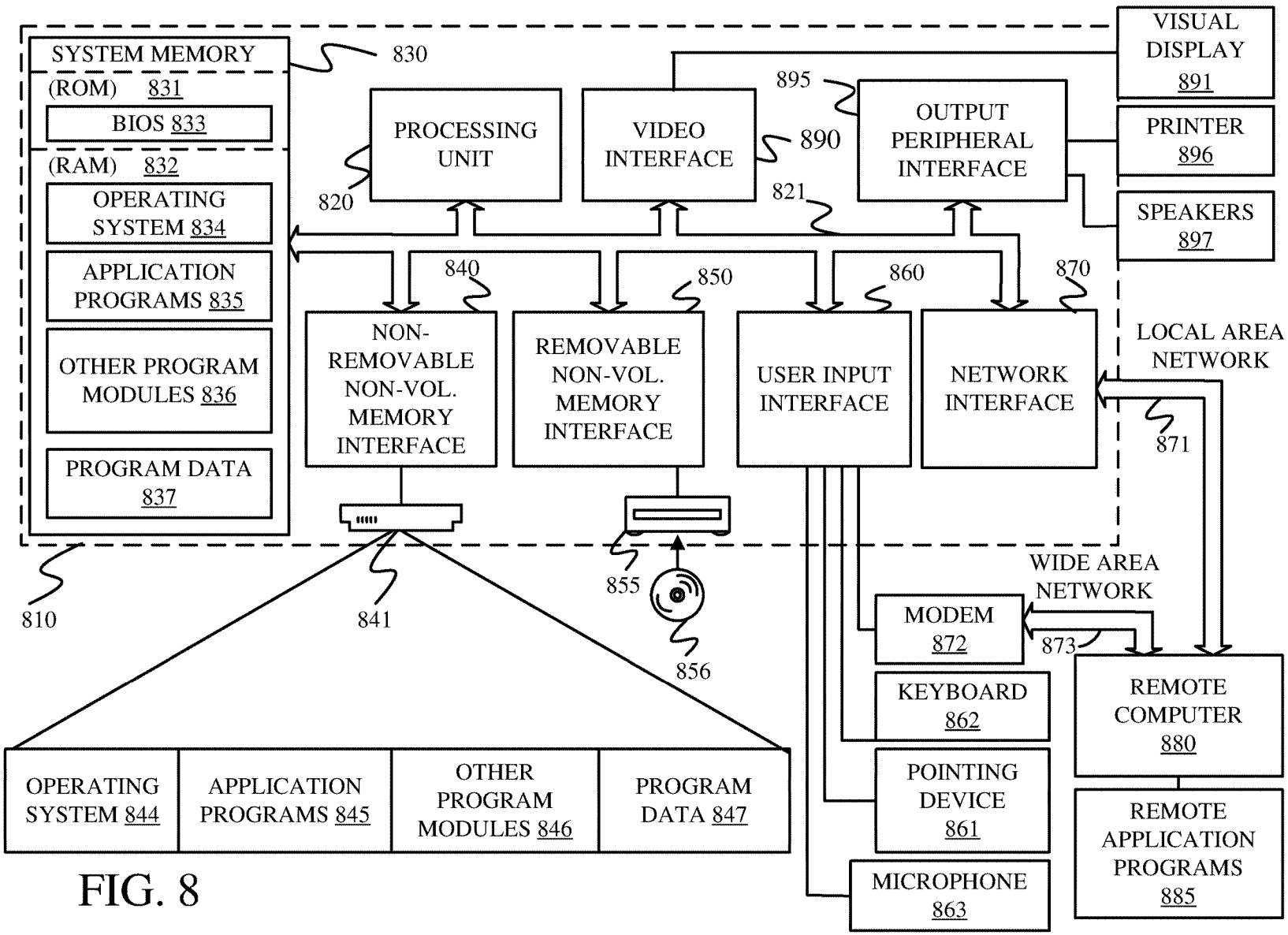
FIG. 8 is a block diagram showing one example of a computing environment that can be used in the architectures shown in the previous Figures.

FIG. 8 is one example of a computing environment in which elements of FIG. 2, or parts of it, (for example) can be deployed. With reference to FIG. 8, an example system for implementing some embodiments includes a general-purpose computing device in the form of a computer 810. Components of computer 810 may include, but are not limited to, a processing unit 820 (which can comprise processors from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 2 can be deployed in corresponding portions of FIG. 8.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable volatile/nonvolatile computer storage media. By way of example only, FIG. 8 illustrates a hard disk drive 841 that reads from or writes to non-removable, nonvolatile magnetic media, a magnetic disk drive 851, nonvolatile magnetic disk 852, an optical disk drive 855, and nonvolatile optical disk 856. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 8, provide storage of computer readable instructions, data structures, program modules and other data for the computer 810. In FIG. 8, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network-WAN, a controller area network-CAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 8 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Example 1 is a mobile construction machine, comprising:

a hydraulic system that is controllable to perform a hydraulic operation;

an engine, operably coupled to the hydraulic system, that provides power to the hydraulic system;

test generation logic that identifies a test profile;

a hydraulic control system that receives the identified test profile and controls the hydraulic system to perform the hydraulic operation to apply a load to the engine, based on the identified test profile; and response detection logic that detects a response of the engine to the applied load.

Example 2 is the mobile construction machine of any or all previous examples wherein the response detection logic comprises:

an engine sensor configured to sense an engine variable that varies based on variation in the response of the engine to the applied load and generate an engine sensor signal indicative of the sensed engine variable.

Example 3 is the mobile construction machine of any or all previous examples wherein the response detection logic comprises:

a communication system configured to generate a controller area network (CAN) message based on the engine sensor signal and store the CAN message in a CAN log.

Example 4 is the mobile construction machine of any or all previous examples wherein the response detection logic comprises:

a hydraulic system sensor configured to sense a hydraulic system variable that varies based on variation in the response of the hydraulic system to the applied load and generate a hydraulic system sensor signal indicative of the sensed hydraulic system variable.

Example 5 is the mobile construction machine of any or all previous examples wherein the communication system is configured to generate a CAN message based on the hydraulic system sensor signal and store the CAN message in the CAN log.

Example 6 is the mobile construction machine of any or all previous examples wherein the test generation logic comprises:

test application machine control logic configured to automatically control the hydraulic system to perform the hydraulic operation to apply the load to the engine, based on the identified test profile.

Example 7 is the mobile construction machine of any or all previous examples wherein the test generation logic comprises:

user interface display generation logic configured to display a user interface message instructing an operator of the mobile construction machine to provide an operator control input to the hydraulic control system to control the hydraulic system to perform the hydraulic operation to apply the load to the engine, based on the identified test profile.

Example 8 is the mobile construction machine of any or all previous examples wherein the test generation logic comprises:

profile accessing logic configured to receive a user test selection input identifying a test and access a test data store to obtain the test profile based on the user test selection input.

Example 9 is the mobile construction machine of any or all previous examples wherein the test generation logic comprises:

a stop condition detection system configured to detect a machine variable indicative of a stop condition and to stop applying the load to the engine based on the stop condition.

Example 10 is the mobile construction machine of any or all previous examples wherein the test generation logic comprises:

test configuration machine control logic configured to control the mobile construction machine to place it in a test mode before the load is applied to the engine.

Example 11 is the mobile construction machine of any or all previous examples wherein the test configuration machine control logic comprises:

override logic configured to override other machine settings to set the machine settings to a test settings value.

Example 12 is a method of controlling a mobile construction machine, comprising:

identifying a test profile;

controlling a hydraulic system, that is controllable to perform a hydraulic operation, to perform the hydraulic operation to apply a dynamic load to an engine, that is operably coupled to the hydraulic system and that provides power to the hydraulic system; and detecting a response of the engine to the applied dynamic load.

Example 13 is the method of any or all previous examples wherein detecting a response comprises:

sensing an engine variable that varies based on variation in the response of the engine to the applied dynamic load;

generating an engine sensor signal indicative of the sensed engine variable;

generating a controller area network (CAN) message based on the engine sensor signal;

and storing the CAN message in a CAN log.

Example 14 is the method of any or all previous examples wherein detecting a response comprises:

sensing a hydraulic system variable that varies based on variation in the response of the hydraulic system to the applied load;

generating a hydraulic system sensor signal indicative of the sensed hydraulic system variable;

generating a CAN message based on the hydraulic system sensor signal; and storing the CAN message in the CAN log.

Example 15 is the method of any or all previous examples wherein controlling the hydraulic system comprises:

automatically controlling the hydraulic system to perform the hydraulic operation to apply the load to the engine, based on the identified test profile.

Example 16 is the method of any or all previous examples wherein controlling the hydraulic system comprises:

displaying a user interface message instructing an operator of the mobile construction machine to provide an operator control input to the hydraulic control system to control the hydraulic system to perform the hydraulic operation to apply the load to the engine, based on the identified test profile.

Example 17 is the method of any or all previous examples wherein identifying a test profile comprises:

receiving a user test selection input identifying a test;

access a test data store based on the user test selection input; and obtaining, from the test data store, the test profile based on the user test selection input.

Example 18 is the method of any or all previous examples and further comprising:

prior to controlling the hydraulic system to perform the hydraulic operation, controlling the mobile construction machine to place it in a test mode before the load is applied to the engine.

Example 19 is an excavator, comprising:

a hydraulic actuator;

an actuator valve;

a pump, operably coupled to the hydraulic actuator to controllably provide hydraulic fluid under pressure to the hydraulic actuator through the actuator valve;

an engine, operably coupled to the pump, to provide power to the pump;

test generation logic that identifies a test profile;

a hydraulic control system that receives the identified test profile and controls the actuator valve to perform a hydraulic operation with the hydraulic actuator to apply a load to the engine, based on the identified test profile;

an engine sensor configured to sense an engine variable that varies based on variation in the response of the engine to the applied load and generate an engine sensor signal indicative of the sensed engine variable; and a communication system configured to generate a controller area network (CAN) message based on the engine sensor signal and store the CAN message in a CAN log.

Example 20 is the excavator of any or all previous examples wherein the hydraulic actuator, the actuator valve and the pump are part of a hydraulic system on the excavator and further comprising:

a hydraulic system sensor configured to sense a hydraulic system variable that varies based on variation in the response of the hydraulic system to the applied load and to generate a hydraulic system sensor signal indicative of the sensed hydraulic system variable, wherein the communication system is configured to generate a CAN message based on the hydraulic system sensor signal and store the CAN message in the CAN log.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile construction machine, comprising:

a hydraulic system that is controllable to perform a hydraulic operation;

an engine, operably coupled to the hydraulic system, that provides power to the hydraulic system;

test generation logic that identifies a test profile;

a hydraulic control system that receives the test profile and controls the hydraulic system to perform the hydraulic operation to apply a load to the engine, based on the test profile; and response detection logic that detects a response of the engine to the load applied by the hydraulic operation performed by the hydraulic system.

2. The mobile construction machine of claim 1 wherein the response detection logic comprises:

an engine sensor configured to sense an engine variable that varies based on variation in the response of the engine to the load and generate an engine sensor signal indicative of the sensed engine variable.

3. The mobile construction machine of claim 2 wherein the response detection logic comprises:

a communication system configured to generate a controller area network (CAN) message based on the engine sensor signal and store the CAN message based on the engine sensor signal in a CAN log.

4. The mobile construction machine of claim 3 wherein the response detection logic comprises:

a hydraulic system sensor configured to sense a hydraulic system variable that varies based on variation in a response of the hydraulic system to the load and generate a hydraulic system sensor signal indicative of the sensed hydraulic system variable.

5. The mobile construction machine of claim 4 wherein the communication system is configured to generate a CAN message based on the hydraulic system sensor signal and store the CAN message based on the hydraulic system sensor signal in the CAN log.

6. The mobile construction machine of claim 1 wherein the test generation logic comprises:

test application machine control logic configured to automatically control the hydraulic system to perform the hydraulic operation to apply the load to the engine, based on the test profile.

7. The mobile construction machine of claim 1 wherein the test generation logic comprises:

user interface display generation logic configured to display a user interface message instructing an operator of the mobile construction machine to provide an operator control input to the hydraulic control system to control the hydraulic system to perform the hydraulic operation to apply the load to the engine, based on the test profile.

8. The mobile construction machine of claim 1 wherein the test generation logic comprises:

profile accessing logic configured to receive a user test selection input identifying a test and access a test data store to obtain the test profile based on the user test selection input.

9. The mobile construction machine of claim 1 wherein the test generation logic comprises:

a stop condition detection system configured to detect a machine variable indicative of a stop condition and to stop applying the load to the engine based on the stop condition.

10. The mobile construction machine of claim 1 wherein the test generation logic comprises:

test configuration machine control logic configured to control the mobile construction machine to place the mobile construction machine in a test mode before the load is applied to the engine.

11. The mobile construction machine of claim 10 wherein the test configuration machine control logic comprises:

override logic configured to override other machine settings to set the other machine settings to a test settings value.

12. A method of controlling a mobile construction machine, comprising:

identifying a test profile;

controlling a hydraulic system, that is controllable to perform a hydraulic operation, to perform the hydraulic operation to apply a dynamic load to an engine, that is operably coupled to the hydraulic system and that provides power to the hydraulic system: and detecting a response of the engine to the dynamic load.

13. The method of claim 12 wherein detecting a response comprises:

sensing an engine variable that varies based on variation in the response of the engine to the dynamic load;

generating an engine sensor signal indicative of the sensed engine variable;

generating a controller area network (CAN) message based on the engine sensor signal;

and storing the CAN message based on the engine sensor signal in a CAN log.

14. The method of claim 13 wherein detecting a response comprises:

sensing a hydraulic system variable that varies based on variation in a response of the hydraulic system to the dynamic load;

generating a hydraulic system sensor signal indicative of the sensed hydraulic system variable;

generating a CAN message based on the hydraulic system sensor signal; and storing the CAN message based on the hydraulic system sensor signal in the CAN log.

15. The method of claim 12 wherein controlling the hydraulic system comprises:

automatically controlling the hydraulic system to perform the hydraulic operation to apply the dynamic load to the engine, based on the test profile.

16. The method of claim 12 wherein controlling the hydraulic system comprises:

displaying a user interface message instructing an operator of the mobile construction machine to provide an operator control input to a hydraulic control system to control the hydraulic system to perform the hydraulic operation to apply the dynamic load to the engine, based on the test profile.

17. The method of claim 12 wherein identifying the test profile comprises:

receiving a user test selection input identifying a test;

accessing a test data store based on the user test selection input; and obtaining, from the test data store, the test profile based on the user test selection input.

18. The method of claim 12 and further comprising:

prior to controlling the hydraulic system to perform the hydraulic operation, controlling the mobile construction machine to place the mobile construction machine in a test mode before applying the dynamic load to the engine.

19. A excavator, comprising:

a hydraulic actuator;

an actuator valve;

a pump, operably coupled to the hydraulic actuator to controllably provide hydraulic fluid under pressure to the hydraulic actuator through the actuator valve;

an engine, operably coupled to the pump, to provide power to the pump;

test generation logic that identifies a test profile;

a hydraulic control system that receives the test profile and controls the actuator valve to perform a hydraulic operation with the hydraulic actuator to apply a load to the engine, based on the test profile;

an engine sensor configured to sense an engine variable that varies based on variation in the response of the engine to the load and generate an engine sensor signal indicative of the sensed engine variable; and a communication system configured to generate a controller area network (CAN) message based on the engine sensor signal and store the CAN message based on the engine sensor signal in a CAN log.

20. The excavator of claim 19 wherein the hydraulic actuator, the actuator valve and the pump are part of a hydraulic system on the excavator and further comprising:

a hydraulic system sensor configured to sense a hydraulic system variable that varies based on variation in the response of the hydraulic system to the load and to generate a hydraulic system sensor signal indicative of the sensed hydraulic system variable, wherein the communication system is configured to generate a CAN message based on the hydraulic system sensor signal and store the CAN message based on the hydraulic system sensor signal in the CAN log.

* * * * *